United States Patent [19]

Barnett

[11] Patent Number: 4,777,744

[45] Date of Patent: Oct. 18, 1988

[54] DISPLAY BUTTON HAVING INTERCHANGEABLE INDICIA

[76] Inventor: Burton Barnett, 12592 Martha Ann Dr., Rossmoor, Calif. 90720

[21] Appl. No.: 38,320

[22] Filed: Apr. 14, 1987

[51] Int. Cl.[4] ..... A44C 3/00

[52] U.S. Cl. ..... 40/1.6; 40/495

[58] Field of Search ..... 40/1.6, 1.5, 315, 495, 40/5

[56] References Cited

U.S. PATENT DOCUMENTS

| | | | |
|---|---|---|---|
| 553,708 | 1/1896 | Forehand | 40/1.6 |
| 725,585 | 4/1903 | Pollock | 40/1.6 |
| 784,077 | 3/1905 | Smith et al. | 40/1.6 |
| 1,426,487 | 8/1922 | Laux | 40/1.6 |
| 1,740,822 | 12/1929 | Kupfer | 40/1.6 |
| 2,360,815 | 10/1944 | Mungen | 40/1.5 |
| 2,408,224 | 9/1946 | Palmer | 40/1.6 |
| 3,557,478 | 1/1971 | Sitzberger | 40/1.5 |

FOREIGN PATENT DOCUMENTS

| | | | |
|---|---|---|---|
| 2733098 | 2/1979 | Fed. Rep. of Germany | 40/1.6 |
| 22508 | of 1897 | United Kingdom | 40/1.6 |

*Primary Examiner*—Gene Mancene
*Assistant Examiner*—Cary E. Stone
*Attorney, Agent, or Firm*—Klein & Szekeres

[57] ABSTRACT

A display button includes a front body member which has an opening or window. A disc-shaped member is rotatably mounted behind the front body member and retained there by a retainer member wedged or friction-fitted into a rearwardly folded circumferential lip or ear of the front body member. The disc-shaped member has at least one slot into which an indicia carrying insert can be inserted either through a slot of the window or of the retainer member. A plurality of distinct and unique indicia are affixed to the disc-shaped member on the side which faces the front body member, positioned so that each indicia can be brought into registry with and selectively displayed through the window.

3 Claims, 2 Drawing Sheets

FIG. 1 PRIOR ART
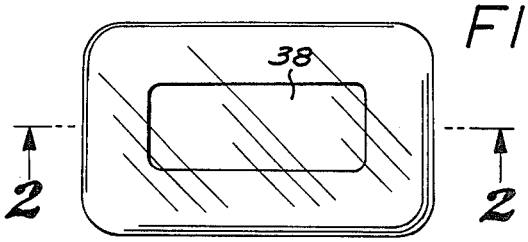
FIG. 2 PRIOR ART
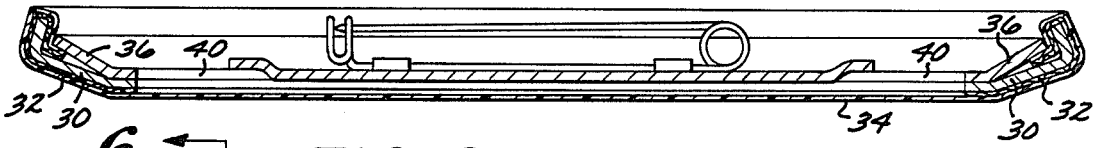
FIG. 3
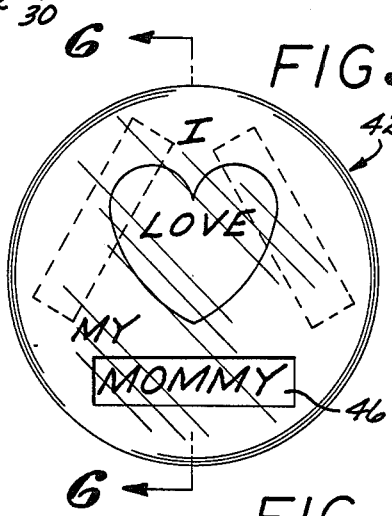
FIG. 4
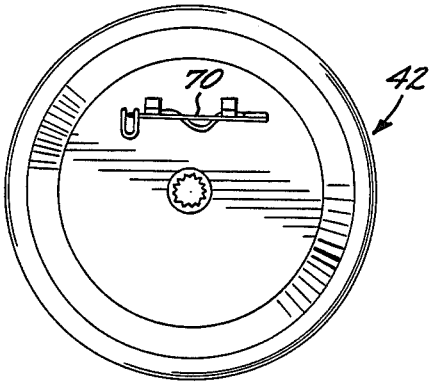
FIG. 7
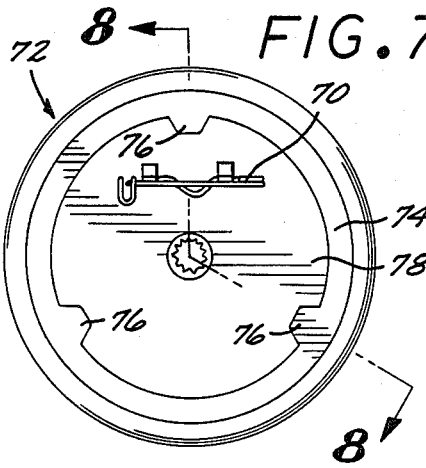
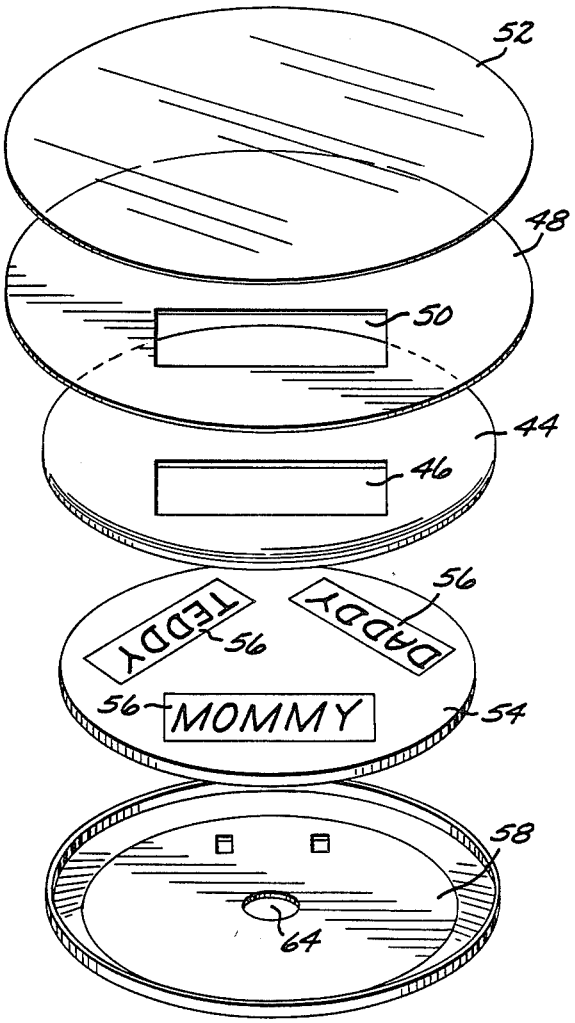
FIG. 5

DISPLAY BUTTON HAVING INTERCHANGEABLE INDICIA

BACKGROUND OF THE INVENTION

1. Field of the Invention

The present invention is directed to display buttons. More particularly, the present invention is directed to display buttons which can carry several interchangeable messages or indicia.

2. Brief Description of the Prior Art

Display buttons are well known in the prior art. The ordinary and most frequently used display buttons of the prior art have permanently affixed indicia which usually comprise a picture, drawing, and/or some type of written message.

The above-summarized prior art display buttons having permanently affixed indicia are relatively simple to construct. In accordance with one usual practice of construction, the display buttons of the prior art include a front body member made of metal or plastic. The front body member may carry the indicia either directly engraved or printed on its front surface, or the front body member may support "artwork" in the form of a paper (or like) label or sticker. Customarily, a thin transparent plastic (MYLAR) sheet covers the front body member to protect the artwork. Edges of the front body member are usually folded back so as to form a circumferential lip. A rear body member is wedged within the folded back lip of the front body member. The thin transparent cover sheet and the "artwork" carrying label are held between the lips and the rear body member so as to be stretched on the front surface of the front body member. The indicia affixed to the button in this manner are, of course, not changeable. When a user wishes to display a different picture or message, he or she must get a different display button.

The present inventor is aware of only one type of display button (or like) device in which a user can change the message or indicia. This prior art device is shown on FIGS. 1 and 2 of the appended drawings. It has a substantially rectangular front frame plate 30 to which a thin non-transparent plastic or paper front 32 and a thin transparent plastic (MYLAR or like) cover 34 are mounted. A substantially rectangular metal back plate 36 is mounted behind the front frame plate 30. The front frame plate 30 and the non-transparent front 32 form a window 38. Slots 40 provided in the back plate 36 permit the removable placement of indicia carrying paper or like cards (not shown) in front of the back plate 36, so as to be displayed in the window 38.

The present invention represents a further improvement in the art and provides display buttons in which a user can readily interchange the messages or indicia displayed by the button.

SUMMARY OF THE INVENTION

It is an object of the present invention to provide a display button in which a user can readily change the message or indicia displayed by the button.

It is another object of the present invention to provide a display button in which a user can readily change at least a portion of the message or indicia displayed by the button by simple manipulation of a rotatable member of the button.

It is still another object of the present invention to provide a display button in which a message or indicia carrying part is readily replaceable so as to change the message or indicia.

The foregoing and other objects and advantages are attained by a display button which has a non-transparent front body having a window-like opening, and an indicia carrying member rotatably mounted behind the front body. The indicia-carrying member has a plurality of different and unique indicia, each of which is aligned on the member in such a way that it can be selectively displayed in the window in a given position of the member relative to the front body. A retainer member is mounted to the back of the front body to retain the rotatable indicia carrying member in operative position.

In accordance with another aspect of the invention the indicia-carrying member is removable from the assembly of the front body and of the retainer member so that labels or stickers (or the like) carrying different indicia can be affixed to the indicia-carrying member.

In accordance with still another aspect of the invention indicia are born by inserts which can be inserted into appropriate opening or holes in the indicia-carrying member.

In yet another embodiment of the display button of the invention the front body has a window and a frame is mounted into the window. The frame is adapted to removably receive and retain a photograph, or a picture, or message-bearing card which is selected at the option of a user of the button.

The features of the present invention which are believed to be novel can be best understood, together with further objects and advantages, by reference to the following description, taken in connection with the accompanying drawings wherein like numerals indicate like parts.

BRIEF DESCRIPTION OF THE DRAWINGS

FIG. 1 is a front plan view of a prior art display button;

FIG. 2 is a cross-sectional view of the prior art display button of FIG. 1, the cross-section being taken on lines 2,2 of FIG. 1;

FIG. 3 is a front plan view of a first preferred embodiment of a display button of the present invention;

FIG. 4 is a rear view of the first preferred embodiment;

FIG. 5 is an exploded perspective view of the first preferred embodiment;

FIG. 7 is a rear view of a second preferred embodiment of the display button of the present invention;

DESCRIPTION OF THE PREFERRED EMBODIMENTS

Figure 6:
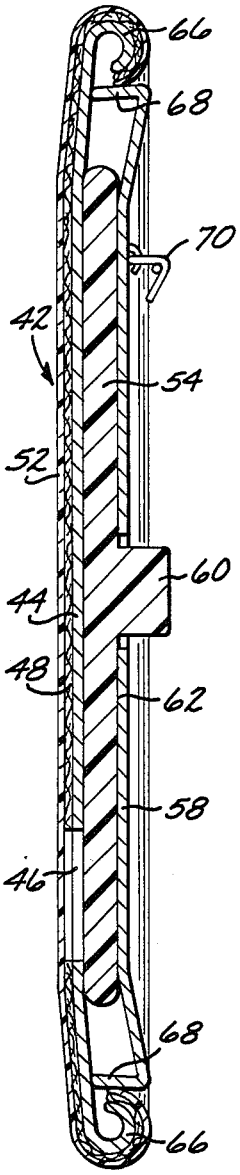
FIG. 6 is a cross-sectional view of the first preferred embodiment, the cross-section being taken on lines 6,6 of FIG. 3.

The following specification taken in connection with the drawings sets forth the preferred embodiments of the present invention. The embodiments of the invention disclosed herein are the best mode contemplated by the inventor for carrying out his invention in a commercial environment, although it should be understood that various modifications can be accomplished within the parameters of the present invention.

Referring now to FIGS. 3 through 6 of the appended drawings, a first preferred embodiment 42 of the display button of the present invention is disclosed. The first preferred embodiment 42 includes a front body or front plate 44 which has an opening or window 46. Although the window 46 of the first preferred embodiment 42 is rectangular, it should be understood that the shape of the window may be varied within the scope of the invention. A paper or like thin plastic label or sticker 48 which may carry certain indicia in the form of drawings, pictures, or messages is disposed in front of the front body 44. The indicia carried by the label 48 is hereinafter sometimes referred to as "artwork". The label or sticker 48 carrying the artwork also has a window 50 which, in the assembled display button 42, is aligned with the window 46 of the front body 44. It should be expressly understood that the artwork of label 48 is permanently displayed. Although the variations on the artwork are limitless, it preferably displays a message which applies in combination with the other variable messages which can be displayed in the hereinafter-described manner by the display button 42 of the invention. The artwork of the herein-shown preferred embodiment includes the words "I LOVE". It should also be understood that optionally the artwork may be altogether omitted from certain embodiments of the display button of the present invention.

A transparent thin plastic (or like) membrane 52 is disposed in front of the artwork-carrying label 48. The primary purpose of the membrane or cover 52 is to protect the artwork. Nevertheless, in some embodiments the transparent cover 52 may be altogether omitted. Preferably, the membrane is made from MYLAR which, although a trade name designation, is a well-known plastic material.

An indicia-carrying disc 54 is mounted behind the front body 44. The disc 54 has a plurality of unique and distinct indicia 56, each of which is disposed on the disc 54 in such a manner that the indicia 56 can be aligned with the windows 46 and 50 and can therefore be displayed through the windows 46 and 50. As is shown for the herein-described preferred embodiment 42, the indicia 56 comprise the words "MOMMY", "DADDY", and "TEDDY", each of which can be displayed through the windows 46 and 50 in a respective rotational position of the disc 54. As it will be well understood by those skilled in the art, a limitless variety of indicia 56, containing a limitless variation of messages, pictures, and the like, are possible within the scope of the invention. The indicia 56 may be directly printed, engraved, or otherwise applied to, or formed together, with the disc 54. Most conveniently, the indicia 56 may be applied to the front surface of the disc 54 in the form of adhesively backed stickers (not shown).

A retaining member 58 is disposed behind the indicia-carrying disc 54. The disc 54 has a knob or protrusion 60 centrally located on the back side 62 of the disc 54 opposite to the front side bearing the indicia 56. The retaining member 58 has a centrally located aperture 64 through which the knob 60 protrudes in the assembled display button 42.

Referring now primarily to FIG. 6, the front body 44, which is advantageously stamped from sheet metal, or injection molded from plastic, is shown to have a circumferential folded back lip 66. The retainer member 58 has a circumferential forwardly folded ear or flange 68. The flange 68 of the retainer member 58 is wedged in the folded back lip 66 of the front body member 44, and the artwork carrying label 48 and the transparent plastic cover 52 are held between the lip 66 of the front body 44 and the flange 68 of the retainer member 58. The retainer member 58 also has a conventional pin assembly 70 which is used to affix the display button to the clothing (not shown) of a user (not shown).

The advantages and the manner of using of the display button 42 of the present invention should be readily apparent from the foregoing description and the drawing figures. The indicia-carrying disc 54 is rotatable relative to the front body member 44. Consequently, a user (not shown) may turn the knob 60 to rotate the disc 54 and select any one of the plurality of indicia 56 to show through the windows 46 and 50. Thus, using the herein specifically illustrated preferred embodiment, a user, in this case probably a child (not shown), may select the overall message "I LOVE MOMMY", or "I LOVE DADDY", or "I LOVE TEDDY". The message shown by the display button 42 may be changed easily and conveniently enough so that even a small child can readily perform the task.

Figure 8:
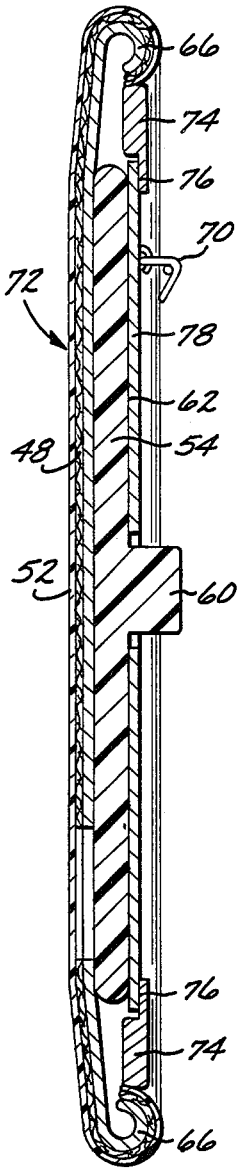
FIG. 8 is a cross-sectional view of the second preferred embodiment, the cross-section being taken on lines 8,8 of FIG. 7.

Referring now to FIGS. 7 and 8, a second preferred embodiment 72 of the display button of the invention is disclosed. The second preferred embodiment 72 is similar in many respects to the above-described first embodiment 42 but is designed to permit easy demounting and remounting of the indicia-carrying disc 54, so that the unique indicia 56 are changeable at the option of a user. To this end, the disc 54 is retained disposed behind the front body 44 by a retainer ring 74. The retainer ring 74 is wedged against the folded back lip 66 of the front body 44. The retainer ring 74 has a plurality, preferably three, radially inwardly projecting prongs 76 which hold a retainer disc 78. The retainer disc 78 is in contact with the back side 62 of the indicia-carrying rotatably mounted disc 54.

To change the indicia 56 on the disc 54 a user (not shown) merely needs to snap the retainer ring 74 out of position, whereafter the indicia-carrying disc 54 can be readily removed from the assembly. Changing the indicia 56 on the disc 54 may be accomplished by applying a label or sticker to the front side of the disc 54, or in certain embodiments, by directly writing on the disc 54. Thus, in the second preferred embodiment 72 of the invention a user (not shown) not only has the option to select among a plurality of indicia 54 which are pre-applied to the disc 54 by a manufacturer, but the user may freely change such indicia 56 to suit his or her individual preference.

Figure 9:
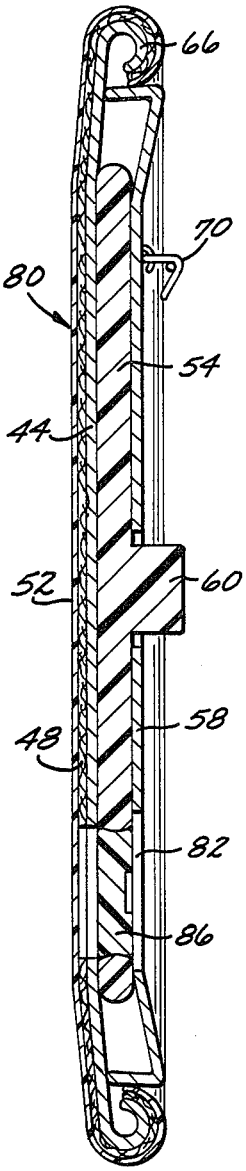
FIG. 9 is a cross-sectional view of a third preferred embodiment of the display button of the present invention.
Figure 10:
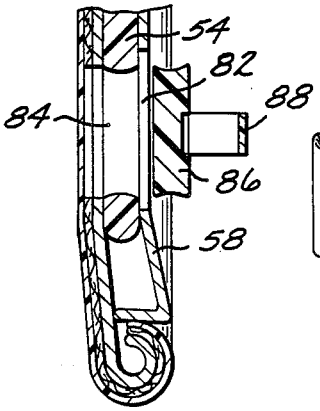
FIG. 10 is a partial cross-sectional view of the third preferred embodiment with an indicia-carrying insert removed.
Figure 11:
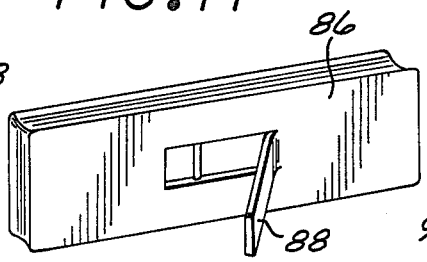
FIG. 11 is a perspective rear view of the indicia-carrying insert of the third preferred embodiment.

FIGS. 9 through 11 demonstrate a third preferred embodiment 80 of the display button of the invention. In the third preferred embodiment 80 there is an opening or slot 82 disposed in the rear retainer member 58. The rotatably mounted disc 54 also has at least one, and preferably three, slots 84 into which indicia-carrying inserts 86 may be mounted by a friction or snap fit, or the like. The inserts 86 have a tab or handle 88 which can be grasped by a user (not shown) to remove the insert 86 from the disc 54. The slot 82 in the retainer member 58 is disposed in such a location that each of the slots 84 of the rotatably mounted disc 54 may be brought in registry with it. Consequently, the indicia-carrying inserts 86 can be mounted and demounted from the rotatable disc 54 through the slot 84.

Figure 12:
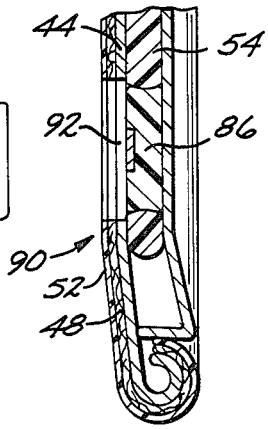
FIG. 12 is a partial cross-sectional view of a fourth preferred embodiment of the display button of the present invention.

FIG. 12 illustrates a fourth preferred embodiment 90 of the display button of the invention wherein openings or slots are provided in the front body member 44, in the artwork-carrying label or sticker 48 and in the optional transparent cover membrane 52 so as to permit mounting and demounting of indicia-carrying inserts 86 to the rotatable disc 54. The slot in the front body member has the reference numeral 92 on FIG. 12.

Figure 13:
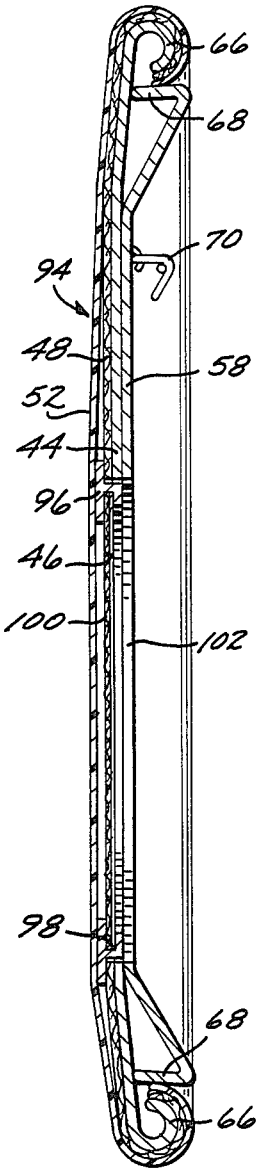
FIG. 13 is a cross-sectional view of a fifth preferred embodiment of the display button of the present invention.

A fifth preferred embodiment 94 of the display button of the present invention is shown in cross-section on Figure 13. In the fifth preferred embodiment 94, as in the above-described other embodiments, a thin transparent plastic membrane 52 and an artwork-carrying label or sticker 48 are disposed in front of a front body member 44. A rear retainer member 58 has a circumferential flange 68 which engages a circumferential folded back lip 66 of the front body member 44.

The front body member 44 of the fifth preferred embodiment 94 has a window 46 into which a frame 96 is mounted. The frame 96 includes an inwardly facing channel 98 which is capable of receiving and holding a photograph or card 100 (or the like) carrying desired indicia. The rear retainer member 58 also has a slot 102 in registry with the frame 96 wherethrough the photograph or card 100 is mountable into the frame 96. It should be apparent from the foregoing that virtually any desired photo, picture, written message, or the like can be inserted by a user (not shown) into the frame 96, and that the message displayed in the frame 96 can be readily changed at the user's option. In this manner a display button having a highly individualized message can be created by the user (not shown).

Several modifications of the display buttons of the invention may become readily apparent to those skilled in the art in light of the foregoing disclosure. Therefore, the scope of the present invention should be interpreted solely from the following claims as such claims are read in light of the foregoing disclosure.

What is claimed is:

1. A display button of the type which is normally pinned to a person's clothing to display short messages, indicia, and the like, the button comprising:

a non-transparent front button body having a window;

an indicia-carrying member rotatably mounted behind the front body, the carrying member having a plurality of different and unique indicia, each of which is selectively displayable through the window, the indicia-carrying member including an opening;

an insert removably mountable into the opening, the opening being alignable with the window, the insert carrying at least one of the unique indicia, whereby the indicia is changeable at the option of the user by changing the insert, and retaining means mounted to the front button body behind the indicia-carrying member for retaining the indicia-carrying member in its rotatable position relative to the button body, the retaining means including a retainer disc having an opening being alignable with the opening of the indicia-carrying member, whereby the insert can be mounted into the indicia-carrying member through the opening of the retainer disc.

2. A display button of the type which is normally pinned to a person's clothing to display short messages, indicia, and the like, the button comprising:

a non-transparent front button body having a window;

an indicia-carrying member rotatably mounted behind the front body, the carrying member having a plurality of different and unique indicia, each of which is selectively displayable through the window, the indicia-carrying member including an opening;

an insert removably mountable into the opening, the opening being alignable with the window, the insert carrying at least one of the unique indicia, whereby the indicia is changeable at the option of the user by changing the insert, and retaining means mounted to the front button body behind the indicia-carrying member for retaining the indicia-carrying member in its rotatable position relative to the button body, the window of the front body being dimensioned to permit mounting of the insert into the indicia carrying member through the front body.

3. A display button of the type which is normally pinned to a person's clothing to display short messages, indicia, and the like, the button comprising:

a front plate having an opening which comprises a window;

an indicia carrying disc rotatably mounted behind the front plate, the disc being partially concealed by the front plate and partially visible through the window, the disc having a plurality of slots;

a plurality of inserts, each insert being removably insertable into one of the slots of the disc;

a plurality of distinct indicia members, each indicia member being attached to one of the inserts, the disc being configured so that each insert when inserted into the respective slot is aligned in one rotational position of the disc with the window and is visible through the window, and retaining means including a retainer plate disposed behind the disc and mounted to the front plate for retaining the disc in operative positions relative to the front plate, the retainer plate having a slot configured to permit passage of any selected one of the inserts through the slot of the retainer plate, each slot of the disc being alignable with the slot of the retainer plate, whereby the insert is mountable to the disc through the slot of the retainer plate.

* * * * *